US011352193B2

(12) United States Patent
Lv et al.

(10) Patent No.: US 11,352,193 B2
(45) Date of Patent: Jun. 7, 2022

(54) MOISTURE RESISTANT PAD FOR LIQUID CRYSTAL PANEL

(71) Applicants: BOE TECHNOLOGY GROUP CO., LTD., Beijing (CN); HEFEI XINSHENG OPTOELECTRONICS TECHNOLOGY CO., LTD., Anhui (CN)

(72) Inventors: Chao Lv, Beijing (CN); Hui Dong, Beijing (CN); Ran Zhang, Beijing (CN); Xinwei Jiao, Beijing (CN); Baoyong Nie, Beijing (CN); Le Guo, Beijing (CN); Jun Zhang, Beijing (CN); Hengzhen Liang, Beijing (CN)

(73) Assignees: BOE TECHNOLOGY GROUP CO., LTD., Beijing (CN); HEFEI XINSHENG OPTOELECTRONICS TECHNOLOGY CO., LTD., Anhui (CN)

( * ) Notice: Subject to any disclaimer, the term of this patent is extended or adjusted under 35 U.S.C. 154(b) by 448 days.

(21) Appl. No.: 15/774,360

(22) PCT Filed: Sep. 29, 2017

(86) PCT No.: PCT/CN2017/104279
§ 371 (c)(1),
(2) Date: May 8, 2018

(87) PCT Pub. No.: WO2018/149146
PCT Pub. Date: Aug. 23, 2018

(65) Prior Publication Data

US 2020/0283216 A1 Sep. 10, 2020

(30) Foreign Application Priority Data

Feb. 20, 2017 (CN) ..... 201710089597.5

(51) Int. Cl.
*B65D 81/26* (2006.01)
*B65D 65/38* (2006.01)
*B65D 85/48* (2006.01)

(52) U.S. Cl.
CPC ..... *B65D 81/26* (2013.01); *B65D 65/38* (2013.01); *B65D 85/48* (2013.01); *B65D 2585/6835* (2013.01)

(58) Field of Classification Search
CPC ..... B65D 81/26; B65D 65/38; B65D 85/48; B65D 2585/6835
(Continued)

(56) References Cited

U.S. PATENT DOCUMENTS 3,655,034 A * 4/1972 Stollman ..... B65D 81/07 206/454
4,324,012 A * 4/1982 Cannaday ..... A41F 15/007 5/656
(Continued)

FOREIGN PATENT DOCUMENTS

CN 201124961 Y 10/2008
CN 101085653 B 10/2010
(Continued)

OTHER PUBLICATIONS

First Office Action for Chinese Patent Application No. 201710089597.5 dated Feb. 28, 2019.
(Continued)

*Primary Examiner* — Jacob K Ackun
(74) *Attorney, Agent, or Firm* — Calfee, Halter & Griswold LLP

(57) ABSTRACT

A moisture resistant pad for a liquid crystal panel, including at least one moisture resistant construction including a central region and an edge region disposed around the central region, wherein the edge region includes a first
(Continued)

undulation structure disposed around the central region, the first undulation structure being a closed structure for blocking water vapor out of the central region. In the moisture resistant pad for a liquid crystal panel, channels formed within a surface of a product that needs to be moisture resistant are isolated from the external environment so that water vapor in the external environment cannot contact the product surface through the channels. As a result, the pad has good moisture resistance, suitable in transportation environments or in packaging container environments.

2 Claims, 5 Drawing Sheets

(58) Field of Classification Search
USPC ..... 206/453, 454, 523
See application file for complete search history.

(56) References Cited

U.S. PATENT DOCUMENTS

| | | | | |
|---|---|---|---|---|
| 4,984,688 | A | 1/1991 | Mikulin | |
| 7,371,115 | B1 | 5/2008 | Hsieh et al. | |
| 8,939,289 | B2 * | 1/2015 | Kuo | B65D 81/05 206/454 |
| 2007/0284282 | A1 | 12/2007 | Yajima et al. | |
| 2013/0293803 | A1 * | 11/2013 | Chen | G02F 1/133308 349/58 |
| 2014/0001070 | A1 | 1/2014 | Zhao | |
| 2014/0166522 | A1 * | 6/2014 | Kuo | B65D 81/058 206/454 |
| 2014/0168916 | A1 * | 6/2014 | Nagaoka | G02F 1/1339 361/752 |

FOREIGN PATENT DOCUMENTS

| | | | |
|---|---|---|---|
| CN | 102717982 | A | 10/2012 |
| CN | 103057855 | A | 4/2013 |
| CN | 103193022 | A | 7/2013 |
| CN | 206544704 | U | 10/2017 |
| DE | 69026544 | | 9/1996 |
| JP | 2016196319 | A | 11/2016 |
| WO | 2005077764 | | 8/2005 |
| WO | 2014173006 | | 10/2014 |

OTHER PUBLICATIONS

Search Report from European Application No. 17866373.8 dated Feb. 12, 2021.

* cited by examiner

II

MOISTURE RESISTANT PAD FOR LIQUID CRYSTAL PANEL

RELATED APPLICATION

This application is the U.S. national phase entry of PCT/CN2017/104279, with an international filing date of Sep. 29, 2017, which claims the benefit of Chinese Patent Application No. 201710089597.5, filed on Feb. 20, 2017, the entire content of which application is incorporated herein by reference.

FIELD OF THE DISCLOSURE

The present disclosure relates to the technical field of a transportation equipment for a display panel, and in particular to a moisture resistant pad for a liquid crystal panel.

BACKGROUND OF THE DISCLOSURE

In an existing liquid crystal panel, polarizers (POL) are attached on an array substrate and a color filter substrate. Polarizers are very sensitive to the humidity in the environment. Defects such as polarizer shrinkage may easily occur due to excessive humidity, which may cause the polarizer to lose its original function so that the entire liquid crystal panel cannot meet the customer's requirements. In addition, if the liquid crystal panel is transported to a region with a relatively high humidity or a region requiring sea transportation, defects such as polarizer shrinkage may easily occur due to excessive humidity in the packaging container.

SUMMARY OF THE DISCLOSURE

In view of this, embodiments of the present disclosure include moisture resistant pads for a liquid crystal panel that has good moisture resistant properties so that the product can be protected from moisture in transportation environments or packaging container environments.

The present disclosure provides a moisture resistant pad for a liquid crystal panel including at least one moisture resistant construction including a central region and an edge region disposed around the central region, wherein the edge region includes a first undulation structure disposed around the central region, the first undulation structure being a closed structure for blocking water vapor out of the central region. According to an aspect of the present disclosure, the first undulation structure includes an annular projection which is disposed along a circumference of the moisture resistant construction and close to an edge of the moisture resistant construction; or the first undulation structure comprises a plurality of annular projections nested in each other and spaced from each other; and each of the annular projections is disposed along the circumference of the moisture resistant construction, and an outermost annular projection is close to the edge of the moisture-resistant construction.

According to certain embodiments of the present disclosure, the first undulation structure includes at least two annular groups, and the at least two annular groups are continuously arranged in a closed loop along a circumference of the moisture resistant construction, and the edge shape of the closed loop is consistent with the edge shape of the moisture resistant construction. Each annular group includes one annular projection, or a plurality of annular projections that are nested and spaced from each other.

According to certain embodiments of the present disclosure, the at least one moisture resistant construction comprises two moisture resistant constructions facing away from each other; and the two first undulation structures on two moisture resistant constructions are symmetrically disposed. For each of the moisture resistant constructions, the first undulation structure includes a first annular projection and a second annular projection, each of which is in the shape of a closed loop and is disposed at an edge of the moisture resistant construction along the circumference in the moisture resistant construction; the second annular projection is nested inside the first annular projection and forms an edge depressed region therebetween and a central depressed region is formed inside the second annular projection; the central depressed region is for housing the liquid crystal panel.

According to certain embodiments of this disclosure, at least one moisture resistant construction comprises a moisture resistant construction and the first undulation structure comprises a closed first annular boss disposed at the edge of the moisture resistant construction along the circumference of the moisture resistant construction and a central depressed region is formed inside the first annular boss for housing the liquid crystal panel; and a closed annular projection protrudes from the first annular boss, disposed along the circumference of the moisture resist construction. A second annular boss is provided on a back surface of the moisture resistant pad facing away from the moisture resistant construction, disposed at an edge of the back surface along a circumference of the back surface, wherein a central depressed region is formed inside the second annular boss, the central depressed region in the first annular boss and the central depressed region in the second annular boss are symmetrically arranged for housing a liquid crystal panel; and a closed annular recess is formed at a position corresponding to the annular projection, and when two moisture resistant pads are stacked on each other, the annular recess is engaged with the annular projection.

According to certain embodiments of the present disclosure, a second undulation structure is further formed in the central depressed region, the second undulation structure has a closed loop shape and is used to block any water vapor in the first undulation structure from entering the second undulation structure.

According to certain embodiments of the present disclosure, the second undulation structure comprises an annular projection which is disposed along the circumference of the central depressed region and adjacent to the edge of the central depressed region; or the second undulation structure comprises a plurality of annular projections nested with each other and spaced from each other. Each of the annular projections is disposed along the circumference of the central depressed region, and the outermost annular projection is near the edge of the central depressed region.

According to certain embodiments of the present disclosure, the second undulation structure comprises at least two annular groups, and the at least two annular groups are continuously arranged in a closed loop along a circumference of the central depressed region, and an edge shape of the closed loop is consistent with an edge shape of the central depressed region. Each annular group comprises an annular projection, or a plurality of annular projections that are nested and spaced from each other.

According to certain embodiments of this disclosure, the top of the second undulation structure is lower than the top of the first undulation structure.

According to certain embodiments of the present disclosure, for each surface of the liquid crystal panel that needs moisture protection, there can be more than one moisture resistant pads, and the first undulation structures of two adjacent moisture resistant pads are stacked facing each other, and the first undulation structures of two adjacent moisture resistant pads are symmetrical to each other.

The present disclosure has the following beneficial effects: in the moisture resistant pad provided by the present disclosure, by a first undulation structure shaped in a closed loop in a moisture resistant construction, water vapor can be kept out of a periphery of the moisture resistant construction. That is, the channels formed by the first undulation structure and the product surface are isolated from the outside environment so that water vapor in the external environment cannot reach the surface of the product. Therefore, the pad has good moisture resistance so that the product can be protected from moisture in transportation environments or packaging container environments.

The present disclosure also relates to a packaging container including the above moisture resistant pad, in particular a liquid crystal panel packaging container.

DETAILED DESCRIPTION OF THE DISCLOSURE

To enable those skilled in the art to better understand the technical solutions of the present disclosure, the moisture resistant pad provided in the present disclosure will be described in detail below with reference to the accompanying drawings.

Figure 1:
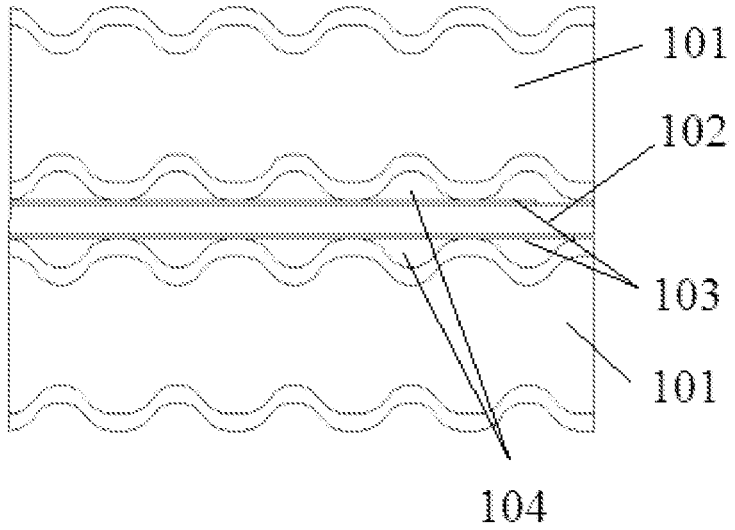
FIG. 1 is a side view of a pad used in a packaging container according to an example of the present disclosure.

FIG. 1 is a side view of a moisture resistant pad 101 for a liquid crystal panel 102 according to an aspect of the present disclosure. As shown in FIG. 1, the pad 101 has a main body and two opposing surfaces, i.e. a first surface (upper surface) and a second surface (lower surface). The first surface and the second surface of the pad 101 are respectively positioned at both sides of the main body. At least one of the first surface and the second surface of the pad 101 has concave-convex structures (in FIG. 1, both surfaces have concave-convex structures), which are wrinkle-shaped undulations. The wrinkle-shaped undulations are in a shape of unclosed stripes. In practical applications, the moisture resistant pad has the following problems: since the wrinkle-shaped undulations are in the shape of unclosed stripes, channels 104 are formed by the wrinkle-shaped undulations of the pad 101 and the surface of the liquid crystal panel 102, the external environment is communicated with the central portion of the liquid crystal panel 102 via the channels 104. When the humidity in the environment is high, the moisture can reach various positions on the surface of the polarizer 103 through the channels 104, resulting in defects such as shrinkage of the polarizer 103 due to excessive humidity, or even losing its original function, resulting in the entire liquid crystal panel 102 failing to meet customer standards.

It should be noted that the terms first, second, third and the like in the description and in the claims, are used for distinguishing between similar elements and not necessarily for describing a sequential or chronological order. It is to be understood that the terms so used are interchangeable under appropriate circumstances and that the embodiments of the disclosure described herein are capable of operation in other sequences than described or illustrated herein.

Although the moisture resistant pad according to FIG. 1 can block moisture of the external environment from reaching the liquid crystal panel 102 in a direction perpendicular to a main surface (i.e., a front surface or a working surface of the liquid crystal panel 102) of the liquid crystal panel 102), the moisture can still pass sideways from a side wall of the liquid crystal panel 102 and reach the liquid crystal panel 102 along the channel 104, therefore the moisture resistant effect is limited. To address these issues, the inventor of the present disclosure has made further improvement and perfection to the moisture resistant pad of FIG. 1.

FIGS. 2-6*e* are structural views of the improved moisture resistant pad(s). Compared with FIG. 1, FIGS. 2-6*e* show the structural distribution of the first surface of the improved moisture resistant pad(s) viewed roughly from a top side.

The improved moisture resistant pad(s) each includes: a main body; and a first surface and a second surface opposite with each other. The first surface and the second surface of the pad are respectively positioned at both sides of the main body. At least one of the first surface and the second surface of the pad has at least one moisture resistant construction that is adjacent to a surface of a product (e.g., a liquid crystal panel) needing moisture protection. The moisture resistant construction is formed with a first undulation structure which is in a closed loop shape, to block the water vapor out of a periphery of the first undulation structure. Since the first undulation structure is in a closed loop shape, channels formed by the first undulation structure and the liquid crystal panel are isolated from the outside environment so that water vapor of the external environment cannot reach the surface of the product not only in a direction perpendicular to a main surface of the liquid crystal panel, but also sideways from a side wall of the liquid crystal panel. Therefore, the pad has a good moisture resistance effect so that the liquid crystal panel can be protected from moisture in transportation environments or packaging container environments.

Each specific example of the present disclosure will be described in more detail below with reference to the accompanying FIGS. 2-6*e*.

A First Embodiment

Figure 2:
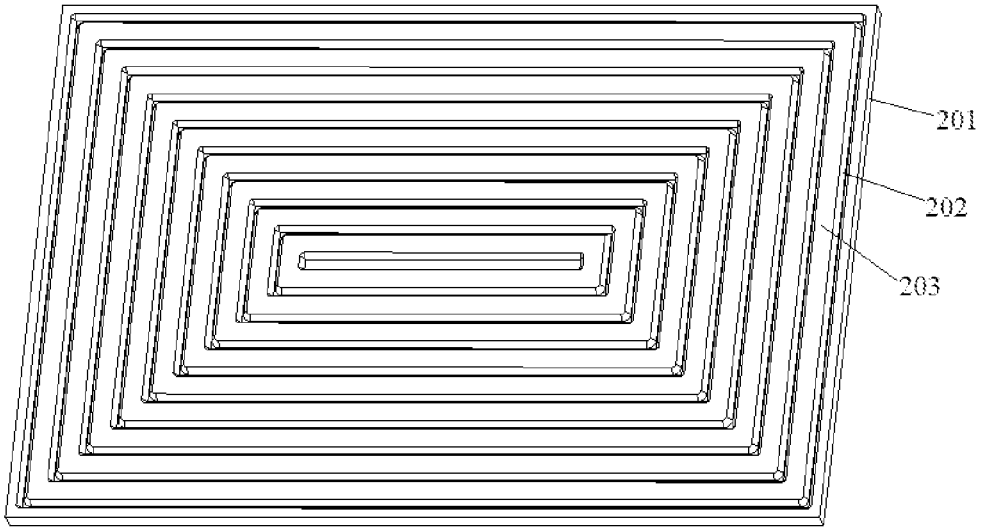
FIG. 2 is a structural view of a moisture resistant pad according to a first embodiment of the present disclosure.

FIG. 2 is a structural view of a moisture resistant pad according to a first embodiment of the present disclosure. Referring to FIG. 2, the moisture resistant pad 201 includes moisture resistant construction(s) 203. The moisture resistant construction 203 may be one, or two, and the two moisture resistant constructions 203 may be opposite to each other. In practical applications, the surface of at least one of polyhedrons may be provided with a moisture resistant construction according to specific requirements to isolate the surface of the product (such as a liquid crystal panel) that needs to be moisture resistant from the external environment.

In this embodiment, the moisture resistant construction 203 is formed with a first undulation structure including a plurality of annular recesses 202, the plurality of annular recesses 202 being nested and spaced apart from each other. In other words, the plurality of annular recesses 202 are arranged concentrically around the center of the moisture resistant construction 203 at different center distances. And each of the annular recesses 202 is disposed along the circumference (periphery) of the moisture resistant construction 203. The annular shape of each annular recess 202 is similar to the edge shape of the moisture resistant construction, and the outermost annular recess 202 is close to the edge of the moisture resistant construction in order to ensure that water vapor can be obstructed from the periphery of the first undulation structure.

Because each annular recess 202 is a closed annular structure, the channel formed with the product surface is isolated from the external environment such that water vapor in the external environment cannot come into contact with the product surface through the channel, and therefore the pad has moisture resistance so that the product can be protected from moisture in the transportation environment and the packaging container environment.

In practical applications, the annular recess 202 may also be one, which is disposed along the circumference of the moisture resistant construction and close to the edge of the moisture resistant construction.

It should be noted that, in the present embodiment, the first undulation structure may also use an annular projection instead of the annular recess 202, or the first undulation structure may also be a combination of an annular projection and an annular recess. The other details are the same as the example described with reference to FIG. 2.

A Second Embodiment

Figure 3:
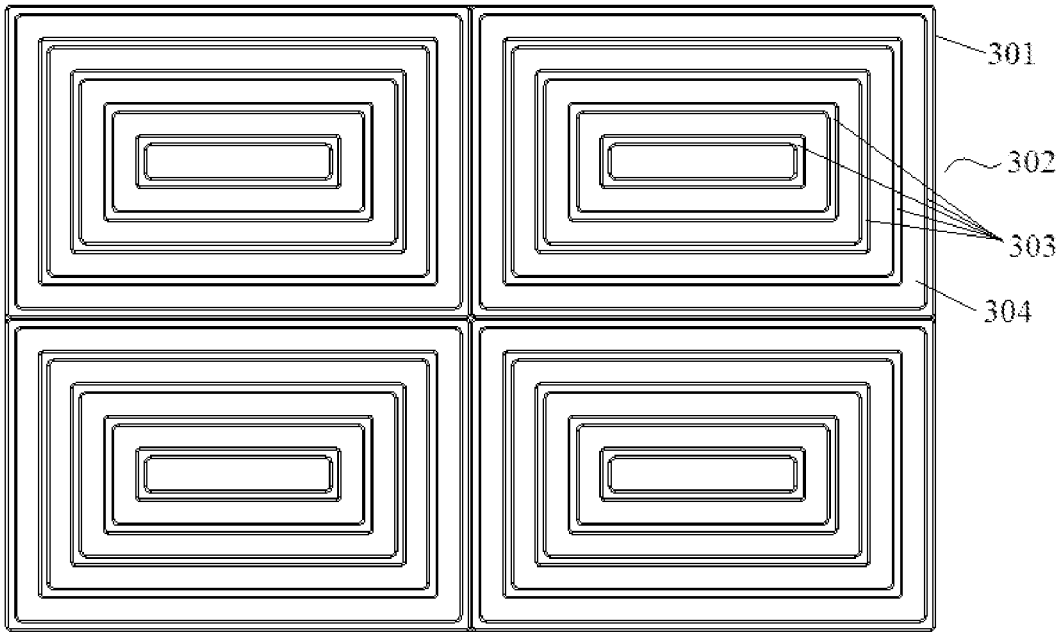
FIG. 3 is a structural view of a moisture resistant pad according to a second embodiment of the present disclosure.

FIG. 3 is a structural view of a moisture resistant pad 301 according to a second embodiment of the present disclosure. Referring to 3, in the present embodiment, the moisture resistant construction 304 is formed with a first undulation structure including at least two annular groups, and the at least two annular groups are continuously arranged in the shape of a closed loop along a circumference of the moisture resistant construction 304, and the edge shape of the closed loop is consistent with the edge shape of the moisture resistant construction. Specifically, four annular groups 302 are shown in FIG. 3. Since each adjacent two annular groups 302 are in close vicinity to each other, the outer peripheries of the four annular groups 302 are spliced in the circumference of the moisture resistant construction 304 to form a closed loop. The edge shape of the closed loop is consistent with the edge shape of the moisture resistant construction 304, i.e., rectangular shape, so as to achieve the function of isolating moisture in the external environment.

For each annular group 302, it includes a plurality of annular recesses 303 nested into each other and spaced apart from each other. Of course, in practical applications, there may be one annular recess 303 for each annular group 302.

It should be noted that, in the present embodiment, instead of the annular recess 303, an annular projection may also be used as the first undulation structure, or the combination of an annular projection and an annular recess may also be used as the first undulation structure.

For the above first and second embodiments, in practical applications, there may be one or more moisture resistant pads for each surface of the product. For the case of a plurality of moisture resistant pads, the first undulation structures of adjacent pair of the moisture resistant pads are stacked relative to one another (that is, the two moisture resistant constructions having the first undulation structures are arranged face to face), and the first undulation structures of two adjacent moisture resistant pads are symmetrical to each other to form closed channels between adjacent two first undulation structures so as to block water vapor in the external environment from entering between the two moisture resistant pads.

Figure 4:
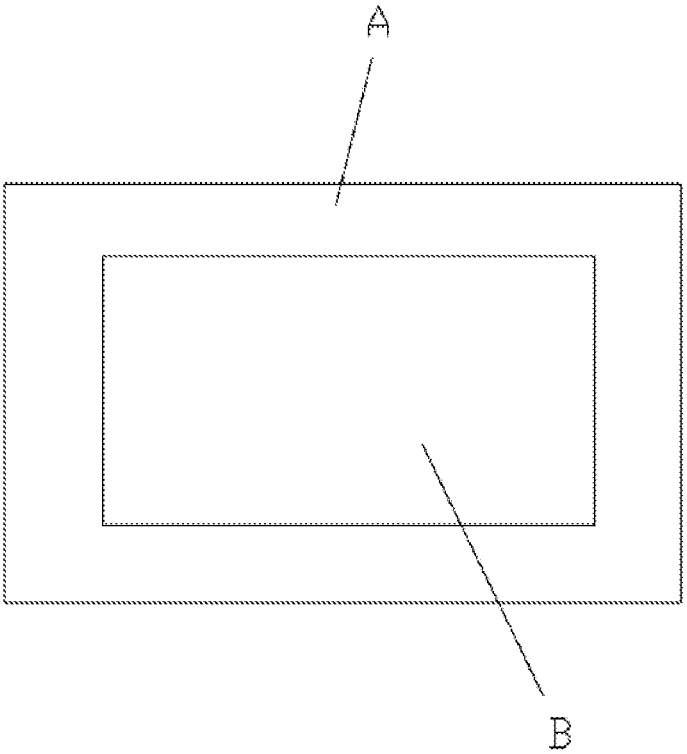
FIG. 4 is a region division view of a moisture resistant construction.

In the above first and second embodiments, in practical applications, as shown in FIG. 4, the moisture resistant construction can be divided into a central region B and an edge region A around the central region B, and in the edge region A, the first undulation structure of any one of the above-mentioned first and second embodiments may be provided. In the same way, in the central region B, the first undulation structure of any one of the above-mentioned first and second embodiments may be provided. The moisture resistant construction is divided into inner and outer regions, and undulation structures are provided in the inner and outer regions independently. Two moisture resistant regions, i.e., the inner region and the outer region, form two barriers to block water vapor, further improving the moisture resistance of the pad.

A Third Embodiment

Figure 5A:
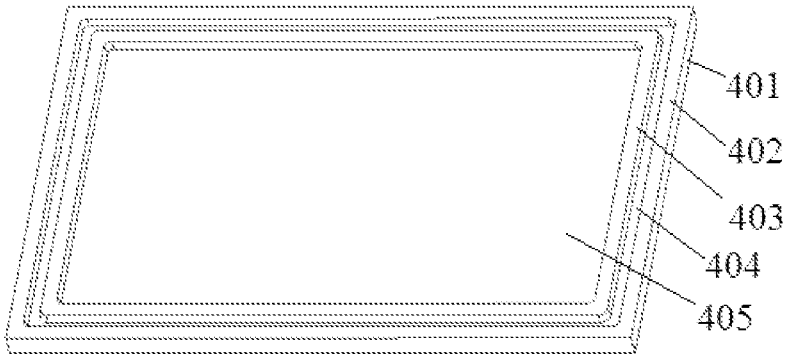
FIG. 5A is a structural view of a moisture resistant pad according to a third embodiment of the present disclosure.
Figure 5B:
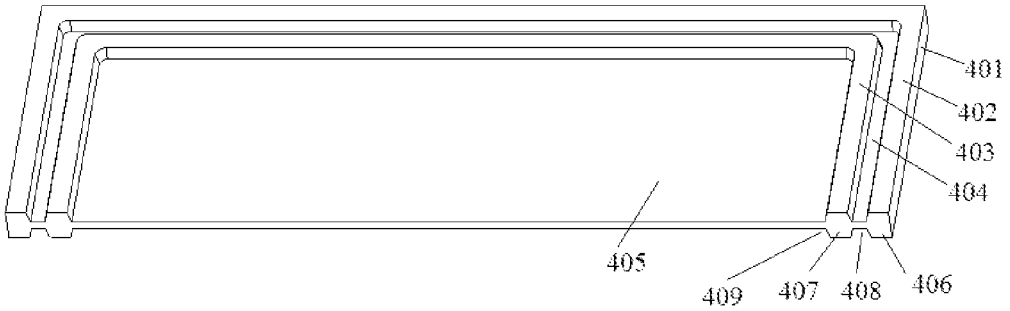
FIG. 5B is a cut away view of the moisture resistant pad according to the third embodiment of the present disclosure.

FIG. 5A is a structural view of a moisture resistant pad according to a third embodiment of the present disclosure. FIG. 5B is a cut away view of the moisture resistant pad according to the third embodiment of the present disclosure. Referring to FIG. 5A and FIG. 5B together, in this embodiment, two moisture resistant pads 401 are required to protect one product from moisture. That is, each product is placed between two adjacent moisture resistant pads 401. For this reason, for each moisture resistant pad 401, there are two moisture resistant constructions and the two moisture resistant constructions face away from (opposite to) each other. The two first undulation structures on the two moisture resistant constructions are symmetrically arranged to jointly protect the product located therebetween from water vapor in the external environment.

Specifically, as shown in FIG. 5B, the upwardly facing upper moisture resistant construction of each moisture resistant pad 401 includes a first undulation structure including a first annular projection 402 and a second annular projection 403, each of which is in the shape of a closed loop and is disposed at the edges of the upper moisture resistant construction along a circumference of the upper moisture resistant construction. The second annular projection 403 nests inside the first annular projection 402 and forms an edge depression region 404 therebetween and a central depressed region 405 is formed inside the second annular projection 403 for housing a product. A downward-facing lower moisture resistant construction of each moisture resistant pad 401 has a first undulation structure which is symmetrical to the first undulation structure of the upper moisture resistant construction. Specifically, the lower moisture resistant construction includes a first annular projection 406 and a second annular projection 407, each of which is in the shape of a closed loop and is disposed at edges of the lower moisture resistant construction along a circumference of the lower moisture resistant construction. The second annular projection 407 nests inside the first annular projection 406 and forms an edge depressed region 408 therebetween and a central depressed region 409 is formed inside the second annular projection 407, 409 for housing a product.

Figure 5C:
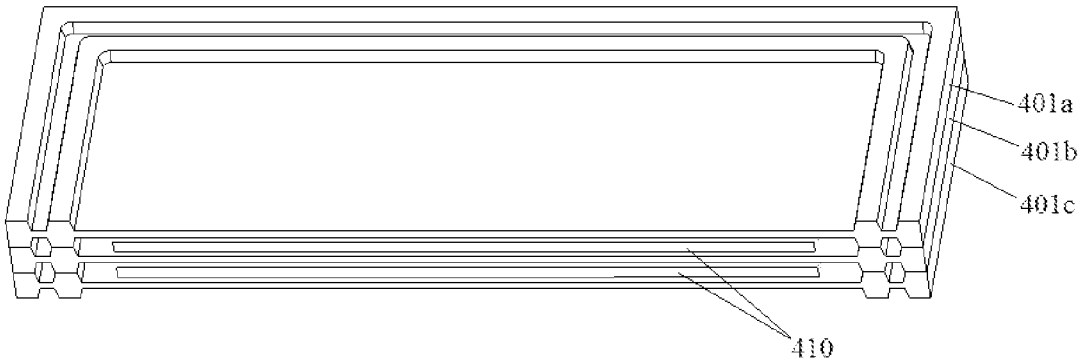
FIG. 5C is a cut away view of a plurality of moisture resistant pads in the third embodiment of the present disclosure.

In FIG. 5C, three moisture resistant pads (401*a*-401*c*) are stacked on top of each other. For each pair of adjacent two moisture resistant pads, the first annular projections of the two are stacked with each other, and the second annular projections of the two are stacked on each other so that the edge depressed regions of the two form a closed annular channel while the central depressed region of the two forms an enclosed space for housing a product 410. As a result, the first undulation structures of the adjacent two moisture resistant pads forms a barrier at the periphery of the product 410 to block water vapor in the environment from entering, and the moisture resistance effect is good.

It should be noted that, in practical applications, the depth of the above central depressed region should be large enough to house the product.

A Fourth Embodiment

Figure 6A:
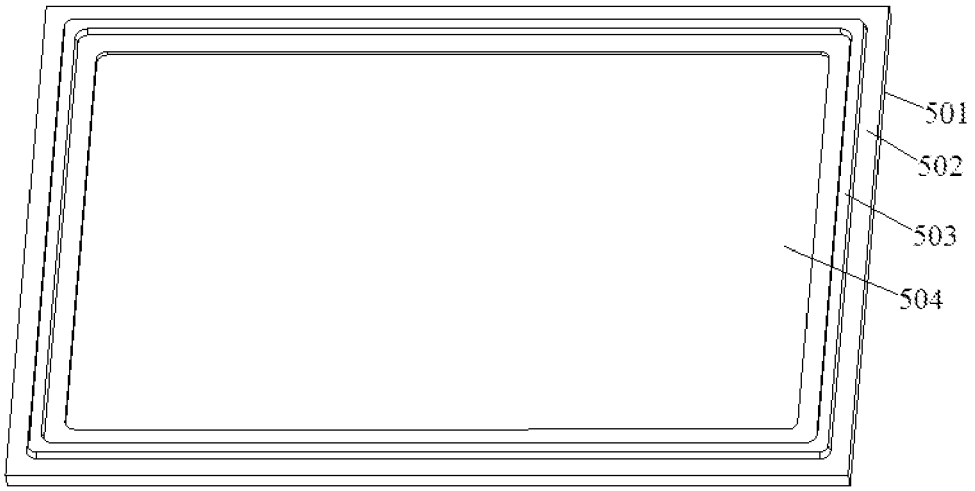
FIG. 6A is a structural view of a moisture resistant pad according to a fourth embodiment of the present disclosure.
Figure 6B:
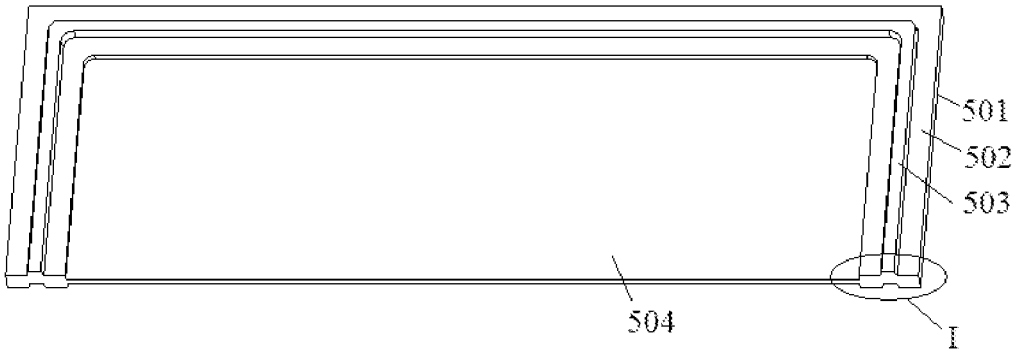
FIG. 6B is a cut away view of a moisture resistant pad according to a fourth embodiment of the present disclosure.
Figure 6C:
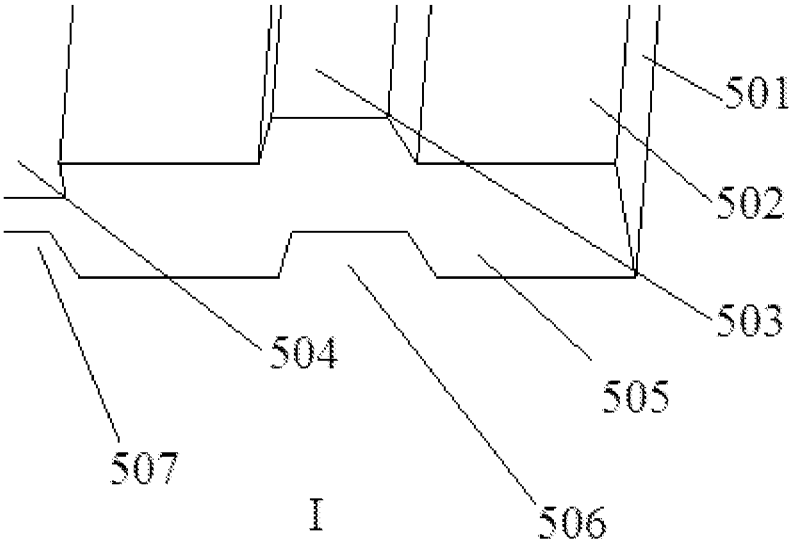
FIG. 6C is an enlarged view of an area I in FIG. 6B.

FIG. 6A is a structural view of a moisture resistant pad according to a fourth embodiment of the present disclosure. FIG. 6B is a cut away view of the moisture resistant pad according to the fourth embodiment of the present disclosure. FIG. 6C is an enlarged view of region I in FIG. 6B. Referring to FIG. 6A to FIG. 6C, in this embodiment, it is required to use two moisture resistant pads 501 to protect one product from moisture, that is, to place each product between two adjacent moisture resistant pads 501.

Specifically, there is one moisture resistant construction, and the first undulation structure of the moisture resistant construction includes a closed first annular boss 502 disposed at the edge of the moisture resistant construction along the circumference of the moisture resistant construction, and a first center depressed region 504 is formed inside the first annular boss 502, and the first center depressed region 504 is used for housing a product. In addition, a closed annular projection 503 is protruded from the first annular boss 502, and the annular projection 503 is disposed along the circumference of the moisture resistant construction.

As shown in FIG. 6C, a second annular boss 505 is provided on a back surface (the surface of the moisture resistant pad 501 facing downward) of the moisture resistant pad 501 away from the moisture resistant construction (the surface located at the upward facing surface of the moisture resistant pad 501). The second annular boss 505 is disposed at the edge of the back surface along a circumference of the back surface, and a second center depressed region 507 is formed inside the second annular boss 505. The second center depressed region 507 is symmetrical to the first central depressed region 504 for housing a product. On the second annular boss 505, a closed annular recess 506 is provided at a position corresponding to the annular projection 503.

Referring to FIG. 6B and FIG. 6C, the structures of the first annular boss 502, the second annular boss 505, the annular projections 503 and the annular recess 506, and the relationship therebetween will be specifically described. The first annular boss 502 is a first upward step as shown in FIG. 6C protruding slightly upward with respect to the first central depressed region 504 (only the right half is labeled with reference numeral 502, while the left half is not marked); the second annular boss 505 is a first downward step as shown in FIG. 6C protruding slightly downward with respect to the second center depressed region 507 (only the right half is marked with reference numeral 505 and the left half is not marked). The annular projection 503 is a second upward step that protrudes upward further in the middle of the first annular projection 502, and the annular recess 506 is a second downward step protruded further downwardly in the middle of the second annular boss 505.

Figure 6D:
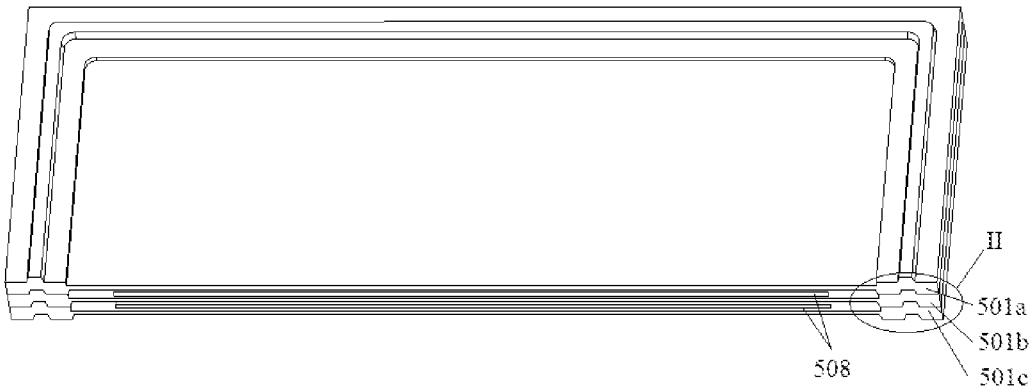
FIG. 6D is a cut away view of a plurality of moisture resistant pads in a fourth embodiment of the present disclosure.
Figure 6E:
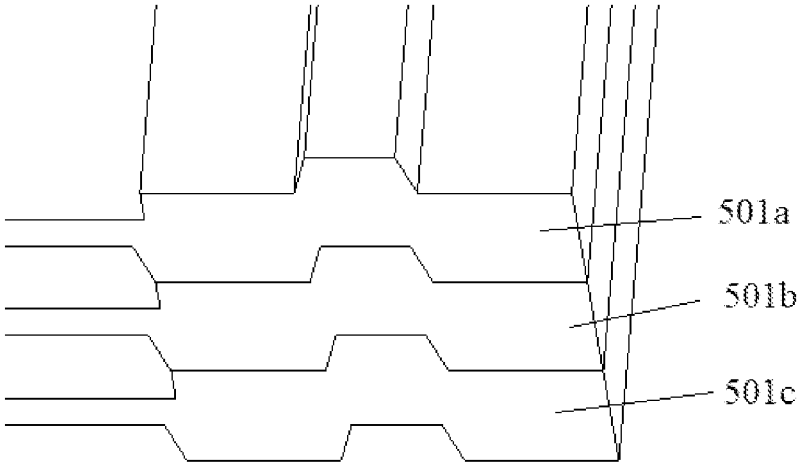
FIG. 6E is an enlarged view of an area II in FIG. 6D.

FIG. 6D is a cut away view of a plurality of moisture resistant pads according to a fourth embodiment of the present disclosure. FIG. 6E is an enlarged view of area II in FIG. 6D. Referring to FIGS. 6D and 6E, three moisture resistant pads (501*a*-501*c*) are stacked on top of each other, and for each pair of adjacent two moisture resistant pads, the annular recess 506 of the upper moisture resistant pad and the annular projection 503 of the lower annular pad 503 are engaged to each other to form a self-sealing structure. And, the second central depressed region of the upper moisture resistant pad and the first central depressed region of the adjacent lower moisture resistant pad form an enclosed space for housing a product 508. Thus, the first undulation structures of two adjacent moisture resistant pads form a barrier around the periphery of the product 508 to block the water vapor in the external environment from entering, and the moisture resistance effect is better.

The present disclosure also relates to a packaging container, in particular a liquid crystal panel packaging container, containing any of the above moisture resistant pads.

It should be noted that, in practical applications, the depths of the first central depressed region and the second central depressed region should be sufficiently large to ensure that the product can be accommodated. For the above third and fourth embodiments, according to an aspect of the present disclosure, for each moisture resistant pad, a second undulation structure may be further formed in the above-mentioned central depressed region, and the second undulation structure is in shape of a closed loop. Water vapor, if any, that enters the inside of the first undulation structure is obstructed from entering the inside of the second undulation structure. In other words, the second undulation structure forms a second barrier against water vapor in the central depressed region, further enhancing the moisture barrier effect of the pad.

The specific structure of the second undulation structure may be any one of the first undulation structures of the first and second embodiments described above. That is, the first undulation structure of the first or second embodiment is disposed in the central depressed region. Since the specific structure of the first undulation structure has been described in detail in the above first and second embodiments, it will not be repeated here.

According to an aspect of the present disclosure, the top of the second undulation structure is lower than the top of the first undulation structure to ensure that the depth of the central depressed region can accommodate the product.

To sum up, in the moisture resistant pad provided by the above embodiments of the present disclosure, channels formed by the first undulation structure and the product surface are isolated from the outside environment so that water vapor in the external environment cannot reach the surface of the product through the channels. Therefore, the pad has good moisture resistance so that the product can be protected from moisture in transportation environments or packaging container environments.

It can be understood that the above embodiments are merely exemplary embodiments used for illustrating the principle of the present disclosure, but the disclosure is not limited thereto. For example, the present disclosure has been described based only on moisture protection conditions of liquid crystal panels, which of course also apply to other generally flat products requiring moisture resistance. For those skilled in the art, various modifications and improvements may be made without departing from the spirit and essence of the present disclosure, and these variations and improvements are also considered as the protection scope of the present disclosure.

The invention claimed is:

1. A moisture resistant pad for a liquid crystal panel comprising:

a main body; and a first surface and a second surface opposite with each other and respectively positioned at both sides of the main body, wherein the first surface is provided with a first moisture resistant construction and the second surface is provided with a second moisture resistant construction, wherein each of the first moisture resistant construction and the second moisture resistant construction comprises a central region and an edge region disposed around the central region, wherein the edge region comprises a first undulation structure disposed around the central region, wherein the first undulation structure is a closed structure for keeping water vapor out of the central region, wherein the first undulation structure of the first moisture resistant construction and the first undulation structure of the second moisture resistant construction are symmetrically arranged, wherein for each of the first moisture resistant construction and the second moisture resistant construction:

the first undulation structure comprises a first annular projection and a second annular projection, each of which is in a shape of a closed loop and is disposed at an edge of the moisture resistant construction along a circumference of the moisture resistant construction, the second annular projection nests inside the first annular projection and forms an edge depressed region between the first annular projection and the second annular projection, and a central depressed region is formed inside the second annular projection for housing the liquid crystal panel.

2. A system for protecting a liquid crystal panel from moisture wherein, for the liquid crystal panel that needs moisture protection, there are a plurality of moisture resistant pads stacked with each other, each moisture resistant pad comprising:

a main body; and a first surface and a second surface opposite with each other and respectively positioned at both sides of the main body, wherein the first surface is provided with a first moisture resistant construction and the second surface is provided with a second moisture resistant construction, wherein each of the first moisture resistant construction and the second moisture resistant construction comprises a central region and an edge region disposed around the central region, wherein the edge region comprises a first undulation structure disposed around the central region, wherein the first undulation structure is a closed structure for keeping water vapor out of the central region, wherein the first undulation structure of the first moisture resistant construction and the first undulation structure of the second moisture resistant construction are symmetrically arranged, wherein for each of the first moisture resistant construction and the second moisture resistant construction:

the first undulation structure comprises a first annular projection and a second annular projection, each of which is in a shape of a closed loop and is disposed at an edge of the moisture resistant construction along a circumference of the moisture resistant construction, the second annular projection nests inside the first annular projection and forms an edge depressed region between the first annular projection and the second annular projection, and a central depressed region is formed inside the second annular projection for housing the liquid crystal panel.

* * * * *